United States Patent [19]

Sewell

[11] 4,172,595

[45] Oct. 30, 1979

[54] TENNIS TALLY

[76] Inventor: J. Terry Sewell, 8558-J Indian School Rd., Scottsdale, Ariz. 85251

[21] Appl. No.: 894,525

[22] Filed: Apr. 10, 1978

[51] Int. Cl.[2] ..... A63B 71/06

[52] U.S. Cl. ..... 273/73 R; 116/225; 235/1 B

[58] Field of Search ..... 273/68, 73 R, 73 J, 273/162 A; 116/130, 131, 135; 235/1 B, 68, 69, 78 R, 78 G, 113, 114

[56] References Cited

U.S. PATENT DOCUMENTS

| | | | |
|---|---|---|---|
| 434,425 | 8/1890 | Cooper | 273/73 R X |
| 448,878 | 3/1891 | Clarke | 273/73 R |
| 2,704,048 | 3/1955 | Perier | 116/135 |
| 2,753,110 | 7/1956 | Simmons | 235/1 B |
| 3,730,131 | 5/1973 | Izzo | 235/114 X |
| 3,763,820 | 10/1973 | Sage | 116/135 |
| 3,777,699 | 12/1973 | Pfleger | 235/113 X |

FOREIGN PATENT DOCUMENTS

| | | | |
|---|---|---|---|
| 849637 | 8/1939 | France | 116/135 |
| 22925 | 10/1913 | United Kingdom | 273/73 R |

*Primary Examiner*—Richard J. Apley

[57] ABSTRACT

A tennis tally includes different colored markers for scoring the opposing sides of a tennis match. The markers are movable to at least four positions so as to be capable of scoring "0", "15", "30" and "40" for each side. The tally may be readily attached to or made integral with the end of a tennis racket handle.

6 Claims, 4 Drawing Figures

FIG. 1
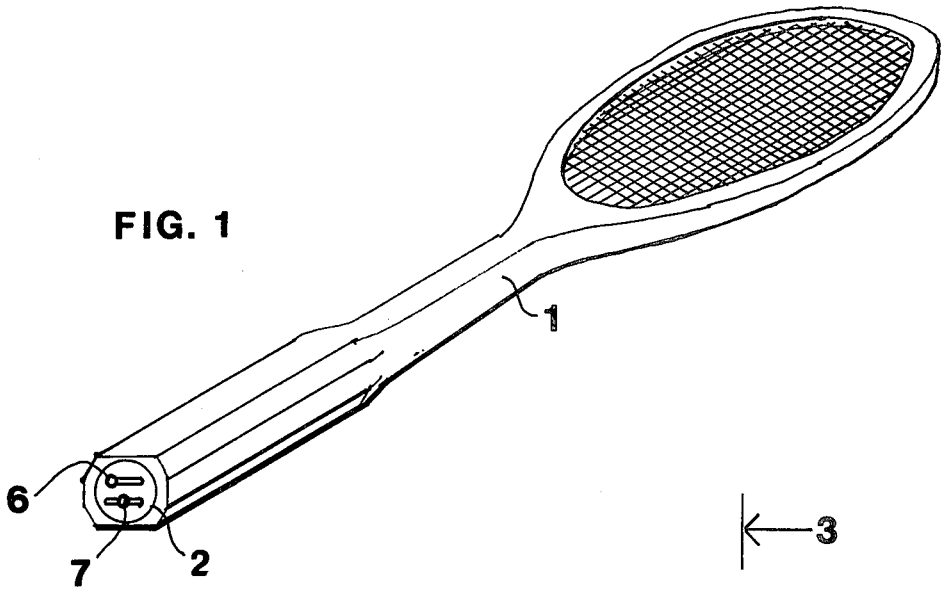
FIG. 2
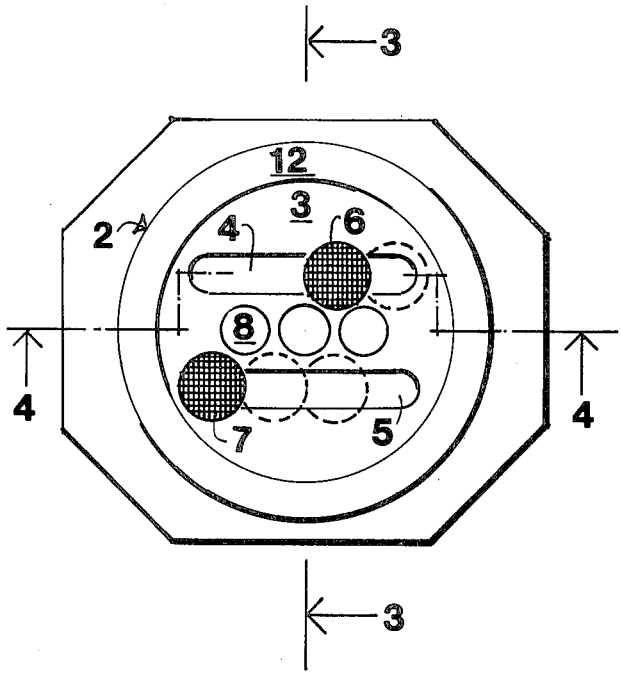
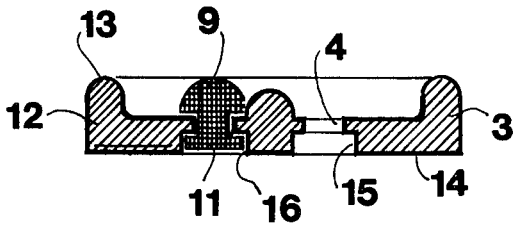
FIG. 3
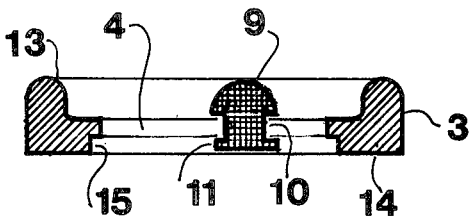
FIG. 4

TENNIS TALLY

BACKGROUND OF THE INVENTION

This invention relates to the game of tennis and more particularly to the scoring of a tennis match.

In the past, tennis matches have been scored mentally by the opposing sides themselves, or, where spectators and/or judges are present by such spectators and/or judges. The first procedure can, of course, lead to some question of the actual score and even with the latter method, does not give the individual player a readily available reminder of the status of the match. There has been the need for some scoring procedure or device satisfying these needs.

SUMMARY OF THE INVENTION

It is an object of this invention to provide a novel scoring device or tally means for tennis.

A further object of this invention is to provide a scoring device for tennis which is readily available for use by the individual players.

A still further object of the invention is to provide a tennis tally which is economical to manufacture.

According to the invention, there is provided a tally for a tennis game consisting primarily of a disc-shaped base member having a pair of parallel elongated slots. A pair of marker pins extend through and slideably engage in said slots. Indexing means for retaining said markers are predeterminedly positioned along said slots. The marker pins include a dome portion, a neck portion and a head portion; the dome portion and head portion engage opposing sides of the disc-shaped base member. The tally may be produced integrally with the handle of a tennis racket.

THE DRAWINGS

Further objects and advantages of the invention will be understood by the following complete description thereof and from the drawings wherein:

FIG. 1 is a perspective view of a tennis racket incorporating a tally in accordance with the invention;

FIG. 2 is an enlarged plan view of the tally; and

FIGS. 3 and 4 are section views thereof taken on lines 3—3 and 4—4 of FIG. 2 respectively.

As mentioned, in the past, tennis matches have been scored mentally by the opposing sides themselves, or, with spectators and/or judges, by such persons. The first procedure can, of course, lead to some question of the actual score and even with the latter method, does not give the individual player a readily available reminder of the status of the match. There has been the need for some scoring procedure or device satisfying these needs.

Looking now at FIG. 1 there is depicted tennis racket 1 with a tally 2 for a tennis game affixed thereto. The tally 2 includes a disc-shaped base member 3 (FIG. 2) having a pair of parallel elongated slots 4 and 5 therein. The base member 3 is of polystyrene but may be of metal or any suitable material. A pair of marker pins 6 and 7 extend through and slideably engage in said slots 4 and 5. Indexing means 8 retain said markers 6 and 7 at predetermined positions along said slots (as seen in phantom positions).

A. The indexing means 8 are projections located between said slots 4 and 5 to engage each of said pair of marker pins 6 and 7.

B. Preferably, the indexing means 8 are circular projections formed integrally with the disc-shaped base member 3.

The marker pins 6 and 7 each include a dome portion 9 (FIG. 3), a neck portion 10 and a head portion 11. The dome portion and head portion engage opposing sides i.e. top and bottom of the disc-shaped base member 3. The marker pins 6 and 7 are preferably of a more resilient plastic, such as a polypropylene, so that they may be snapped into engagement with the slots.

The base member 3 includes an upstanding flange 12 having an upward extension 13 of greater dimension than an upstanding dome 9 of the marker pins 6 and 7. Pedestal means 14 extends from the bottom of said disc-shaped base member 3 a distance greater than the downward extension of the head 11 of the marker pins. The pedestal means 14 may be defined by a pair of grooves 15 and 16 in the body of the base member 3, which grooves surround the pair of slots (FIGS. 3 and 4).

Thus, it will be seen that there is a novel scoring device or tally means for tennis which is readily available for use by the individual players and which is economical to manufacture.

While the invention has been described by way of the preferred embodiment thereof it will be appreciated that suitable modifications may be made therein without departing from the spirit and scope of the invention.

What is claimed is:

1. A tally for a tennis game comprising
   a disc-shaped base member;
   a single pair of parallel elongated slots;
   a pair of marker pins extending through and slideably engaged in said slots; and
   indexing means for retaining said markers at predetermined positions along said slots consisting of a single row of circular projections formed integrally with the disc-shaped base member intermediate the slots so as to coact with the marker pins.

2. A tally as recited in claim 1 wherein said marker pins include a dome portion, a neck portion and a head portion with the dome portion and head portion engaging opposing sides of the disc shaped base member.

3. A tally as recited in claim 1 wherein said base member includes an upstanding flange having an upward extension of greater dimension than an upstanding portion of the marker pins.

4. A tally as recited in claim 1 including pedestal means extending from the bottom of said disc-shaped base member a distance greater than the downward extension of the marker pin.

5. A tally as recited in claim 1 wherein said pedestal means is defined by a pair of grooves in the body of the base member, which grooves surround the pair of slots.

6. A tennis racket having integrally therewith a tally as recited in claim 1.

* * * * *